US006206238B1

(12) United States Patent
Ophardt

(10) Patent No.: US 6,206,238 B1
(45) Date of Patent: Mar. 27, 2001

(54) FINGERPRINT ACTIVATED FLUIDS MIXER AND DISPENSER

(76) Inventor: Heiner Ophardt, 3931 Vineyard Crescent, Vineyard, Ontario (CA), L0R 2C0

( * ) Notice: Subject to any disclaimer, the term of this patent is extended or adjusted under 35 U.S.C. 154(b) by 0 days.

(21) Appl. No.: 09/395,333

(22) Filed: Sep. 13, 1999

Related U.S. Application Data

(63) Continuation-in-part of application No. 09/272,372, filed on Mar. 19, 1999, now Pat. No. 5,960,991.

(51) Int. Cl.[7] ..... B67B 7/00

(52) U.S. Cl. ..... 222/1; 222/52; 222/135; 222/638; 222/144.5

(58) Field of Search ..... 222/52, 135–638, 222/639, 640, 641, 144.5, 30; 235/380, 381, 382; 340/825.34; 380/23; 382/124

(56) References Cited

U.S. PATENT DOCUMENTS

| | | | |
|---|---|---|---|
| 2,387,359 | 10/1945 | Scarry | 222/52 |
| 2,416,221 | 2/1947 | Richardson | 194/72 |
| 3,327,901 | 6/1967 | Yerkovich | 222/52 |
| 3,419,188 | 12/1968 | Matchett | 222/52 |
| 3,434,628 | 3/1969 | Ceraldi | 222/52 |
| 4,645,094 | 2/1987 | Acklin et al. | 222/52 |
| 4,670,010 | 6/1987 | Dragone | 604/289 |
| 4,921,131 | 5/1990 | Binderbauer et al. | 222/52 |
| 4,938,384 | 7/1990 | Pilolla et al. | 222/52 |
| 4,946,070 | 8/1990 | Albert et al. | 222/52 |
| 4,946,072 | 8/1990 | Albert et al. | 222/105 |
| 4,967,935 | 11/1990 | Celest | 222/63 |
| 5,242,081 * | 9/1993 | van der He den et al. | 222/1 |
| 5,452,825 * | 9/1995 | Comstock et al. | 222/135 |
| 5,632,414 | 5/1997 | Merriweather, Jr. | 222/525 |
| 5,695,091 | 12/1997 | Winings et al. | 222/1 |
| 5,810,201 | 9/1998 | Basse et al. | 222/39 |
| 5,960,991 * | 10/1999 | Ophardt | 222/1 |

OTHER PUBLICATIONS

Compaq Fingerprint Identification Technology; http://www.compaq.com/im/fit—2 pages.
http://www.compaq.com/im/fit/fitspec/html—2 pages.
http://www.compaq.com/im/fit/minutiae.html—2 pages.
http://www.compaq.com/im/fit/implement.html—3 pages.

* cited by examiner

*Primary Examiner*—Kevin Shaver
*Assistant Examiner*—Melvin A. Cartagena
(74) *Attorney, Agent, or Firm*—Riches, McKenzie & Herbert

(57) ABSTRACT

A dispenser to dispense material onto a person's hand, comprising: a dispensing device to dispense material from an outlet when the dispensing device is activated, a fingerprint reader adapted to read a fingerprint of a user's finger when located proximate thereon, a control system to activate the dispensing device to dispense material from the outlet when a user's finger is proximate the reader, the outlet and the reader positioned relative each other such that when a user's finger is located proximate the reader material dispensed from the outlet engages a user's hand.

20 Claims, 6 Drawing Sheets

300
301
308
50
46
48
304
20
301
301
51
302
306

300
302
51
301
20
301
310
50
46

FINGERPRINT ACTIVATED FLUIDS MIXER AND DISPENSER

RELATED APPLICATIONS

This application is a continuation-in-part of U.S. patent application Ser. No. 09/272,372, filed Mar. 19, 1999 now U.S. Pat. No. 5,960,991.

SCOPE OF THE INVENTION

This invention relates to dispensers for dispensing metered amounts of materials onto a user's hands and, more particularly, to automated dispensers of hand cleaners which permit controlled monitoring of use.

BACKGROUND OF THE INVENTION

Automatic soap dispensers are known. These dispensers automatically dispense soap when activated as by operation of an electric motor. Known automatic soap dispensers can be activated by a person pushing a button with a user's hand. Other systems sense a user's hand as by with a photosensor and can dispense without the user touching the dispensers as, for example, illustrated in U.S. Pat. No. 4,938,384 to Pilolla et al issued Jul. 3, 1990, and U.S. Pat. No. 5,836,482 to Ophardt et al, issued Nov. 17, 1998.

Washing a person's hands is becoming very important in the food and health industries. In some food industries, there is a legal requirement that workers wash their hands every 20 minutes. There is also a legal requirement that the persons wash their hands after every break or upon entering a clean room as in an operating room in a hospital. These legal requirements give rise to the disadvantage that employers should monitor that people are properly washing their hands to comply with health regulations and proper safety procedures, and to be able to provide evidence of compliance with such regulations and procedures. Presently known systems suffer the disadvantage that it is difficult to monitor hand washing and there is no reliable tracking procedure as to who does or does not wash.

Systems are known where a person punches his ID code into a key pad to operate the soap dispenser. Other systems are known where magnetic cards monitor the entry of persons into clean rooms and alert the user by a warning if that person does not then use the soap dispenser. However, the present applicant has appreciated that these systems suffer the disadvantage that persons can fool these systems by activating the soap dispenser yet merely permitting the dispenser to dispense soap without the soap having to come onto the person's hands and without the person washing their hands.

Fingerprint identification systems are known. For example, as a security system for computers, a fingerprint reader is known to be provided on a computer and the computer can, for example, only be accessed when an authorized fingerprint is read.

SUMMARY OF THE INVENTION

To at least partially overcome these disadvantages of previously known devices, the present invention provides a dispenser to dispense material onto a person's hand which is activated to dispense material when a person's finger is located such that the material dispensed engages the user's hand. Preferably, the material is dispensed only after a fingerprint has been read. Preferably, a sensor mechanism checks to ensure a user's hand is maintained in position to be engaged by the material dispensed while the material is dispensed. Preferably, information is recorded regarding the fingerprint read and/or whether a hand is maintained in position while the material is dispensed will be recorded.

An object of the present invention is to provide a dispenser to dispense material which monitors the person to whom material is dispensed as well as whether the material is dispensed in a desired manner.

Another object is to provide a material dispenser activated by reading a user's fingerprint.

Another object is to provide a method of monitoring and/or controlling dispensing of materials to persons.

Another object is to provide a hand soap dispenser which provides signals to users directing their use.

Another object is to provide a soap dispenser with a fingerprint reader which minimizes the likelihood of passing contamination between successive users' fingers being read.

Another object is to provide a dispenser with a fingerprint reader which cleans the reader after each fingerprint is read.

Another object is to provide a dispensing device which can customize different materials to be dispensed and/or their relative proportions.

Accordingly, in one aspect the present invention provides a dispenser to dispense material onto a person's hand, comprising:

- a dispensing device to dispense material from an outlet when the dispensing device is activated,
- a fingerprint reader adapted to read a fingerprint of a user's finger when located proximate thereon,
- a control system to activate the dispensing device to dispense material from the outlet when a user's finger is proximate the reader,
- the outlet and the reader positioned relative each other such that when a user's finger is located proximate the reader material dispensed from the outlet engages a user's hand.

In another aspect, the present invention provides a dispenser to dispense material onto a person's hand, comprising:

- a dispensing device to dispense material from an outlet when the dispensing device is activated,
- a fingerprint reader having a finger bed, the reader adapted to read a fingerprint of a user when located on the bed,
- a sensing mechanism to sense the location of a finger on the bed,
- a control system to activate the dispensing device to dispense material after the sensing mechanism has sensed the location of the finger on the bed,
- wherein the sensing mechanism senses whether the finger is on the bed while the dispensing device dispenses the material,
- a recording system to maintain a record of a fingerprint read and whether its respective finger was on the bed while the dispensing device dispensed material.

In a further aspect, the present invention provides a method of dispensing material onto a person's hand, comprising:

- placing a user's hand such that a fingertip of a finger to be read is on or proximate a fingerprint reader,
- reading a fingerprint of the user's finger placed on or proximate the fingerprint reader,
- after reading the fingerprint maintaining the user's hand within a control space proximate the reader for a period of time, during said period of time, dispensing material into the control space in a manner that the material engages the user's hand within the control space.

The present invention is applicable to all manners of dispensers. Preferred dispensers are those for which some material is dispensed onto a user's hand carrying the finger whose print is read. Materials useful to be dispensed include cleaning materials, hand washes, disinfectants and the like as particularly useful in washing, cleaning and/or preparing a user's hands. In such dispensers, the dispensing outlet is preferably located such that with a person's hand proximate the fingerprint reader, the material necessarily engages the hand. However, the dispenser can be useful to dispense other materials. For example, after a person's fingerprint is read, the device could mark the back of the user's hand with selected entry stamps visible under normal or ultraviolet light as an indicator that the person has or has not been cleared for entry/security. A person whose fingerprint has been read could be automatically given an injection of, for example, a daily insulin shot, a flu shot or vaccine or other medication. The shot could be injected into, for example, the forearm or other portion of the body necessarily placed in a desired position and, preferably, sensed by the dispenser to be appropriately located.

The present invention in a broader sense could be utilized such that while the person's fingerprint is read which necessitates a person's finger on or proximate to the reader, other portions of the user's body are necessarily in certain juxtaposition to operative devices to interact with the user's body, and without another's body to be substituted. For example, while positioned to have a fingerprint read, the user could be forced to stand on a platform which measures the user's weight. The user's weight could be a cross-check of the user's identity. As a further example, on reading a user's fingerprint, arrangements could be made for a user's feet to necessarily be positioned in desired locations, possibly with sensors to sense the presence of both feet, and cleaning materials, fungicides, etc. could then be dispensed onto the feet. With a user's hand positioned for a fingerprint to be read, it would be possible to have a restraining device such as a handcuff or security gate close to constrain the user against departure.

The present invention can be utilized such that upon identification of a user, the customized activity could be activated. For example, a dispenser could have more than one type of material to be dispensed and on identifying the user, depending the user different of the materials or different mixtures of the materials could be dispensed as customized for the user, as well as by any other factors such as time, day, month, a history of past dispensing and the like. For example, a dispenser might include in one container a soap and in other separate containers fragrances and a disinfectant. Depending upon the preference of the user, as preprogrammed into a control system the amount of the fragrance dispensed relative the amount of soap dispensed may be customized. As a further example, possibly, every fourth time the user washes his hands, the disinfectant would be added in a desired relative amount. As another example, when a user washes his hands more than once in any hour than the amount of disinfectant added could be reduced with each further dispensing in that hour.

Having a dispenser which can selectively dispense from two or more containers can be advantageous to store separate components such as basic components, acidic components and the like which react when mixed so as to render storage when mixed disadvantageous. The mixing of the two or more components can be readily customized for any user.

Having separate containers can also be useful for example to provide a separate material for spraying onto the fingerprint reader pad to clean the reader pad.

BRIEF DESCRIPTION OF THE DRAWINGS

Further aspects and advantages will become apparent from the following description taken together with the accompanying drawings in which.

DETAILED DESCRIPTION OF THE DRAWINGS

Figure 1:
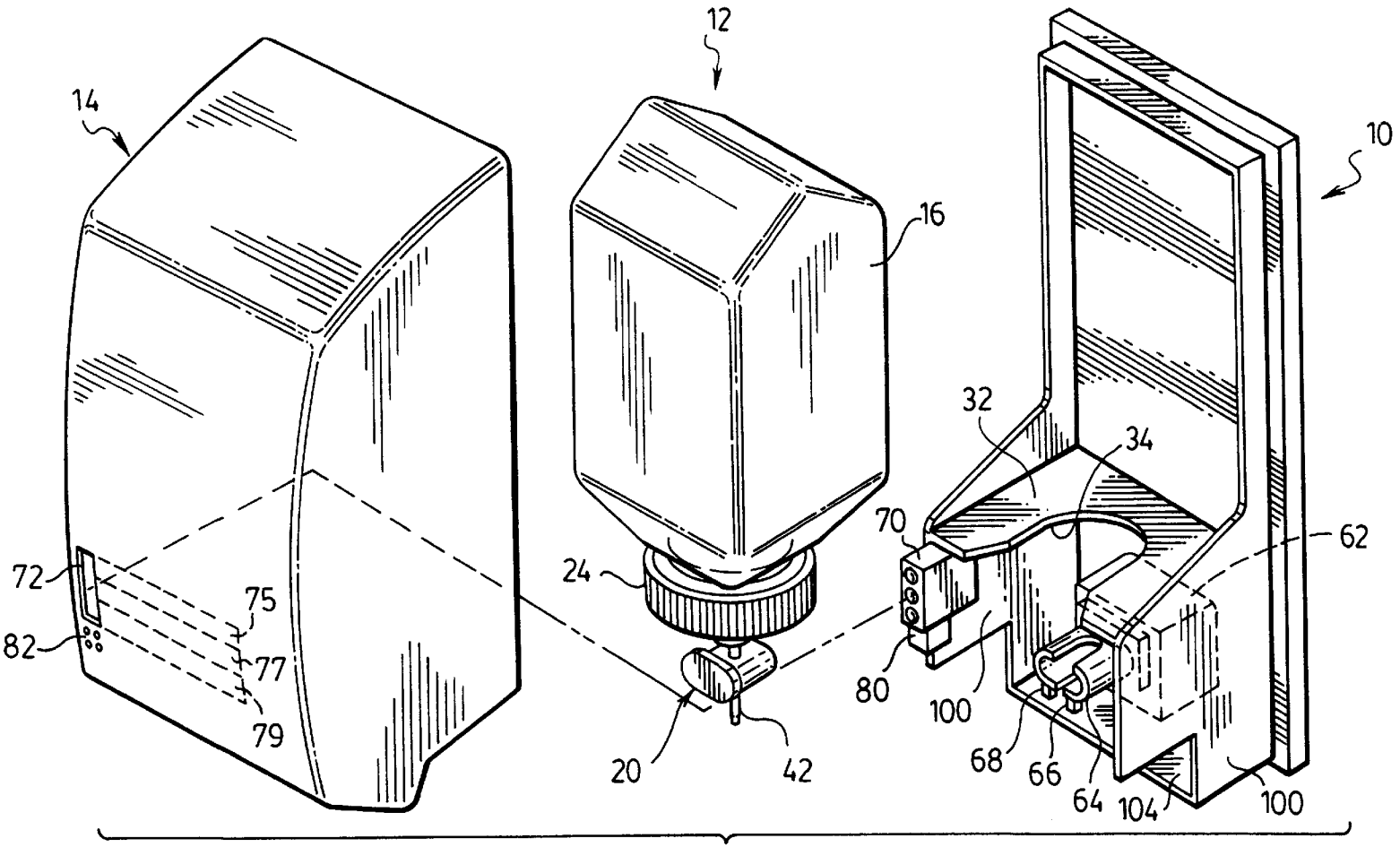
FIG. 1 is an exploded perspective view of a dispenser in accordance with a first embodiment of the present invention.

Reference is made to FIG. 1 which illustrates a soap dispenser taught by U.S. Pat. No. 5,836,482 to Ophardt et al, issued Nov. 17, 1998, the disclosure of which is incorporated herein by reference, however, which dispenser has been modified in accordance with the present invention notably to provide a fingerprint reader 46.

As taught by U.S. Pat. No. 5,836,482, the dispenser comprises a housing 10, a replaceable soap and pump unit 12 and a cover 14. The housing 10 is adapted to be mounted vertically as to a wall. The cover 14 is adapted to be coupled to the housing to permit insertion and removal of the unit 12 preferably as in a known manner with the cover 14 hingedly connected to the housing 12. The replaceable unit 12 comprises a collapsible fluid container 16 and a pump 20.

Figure 2:
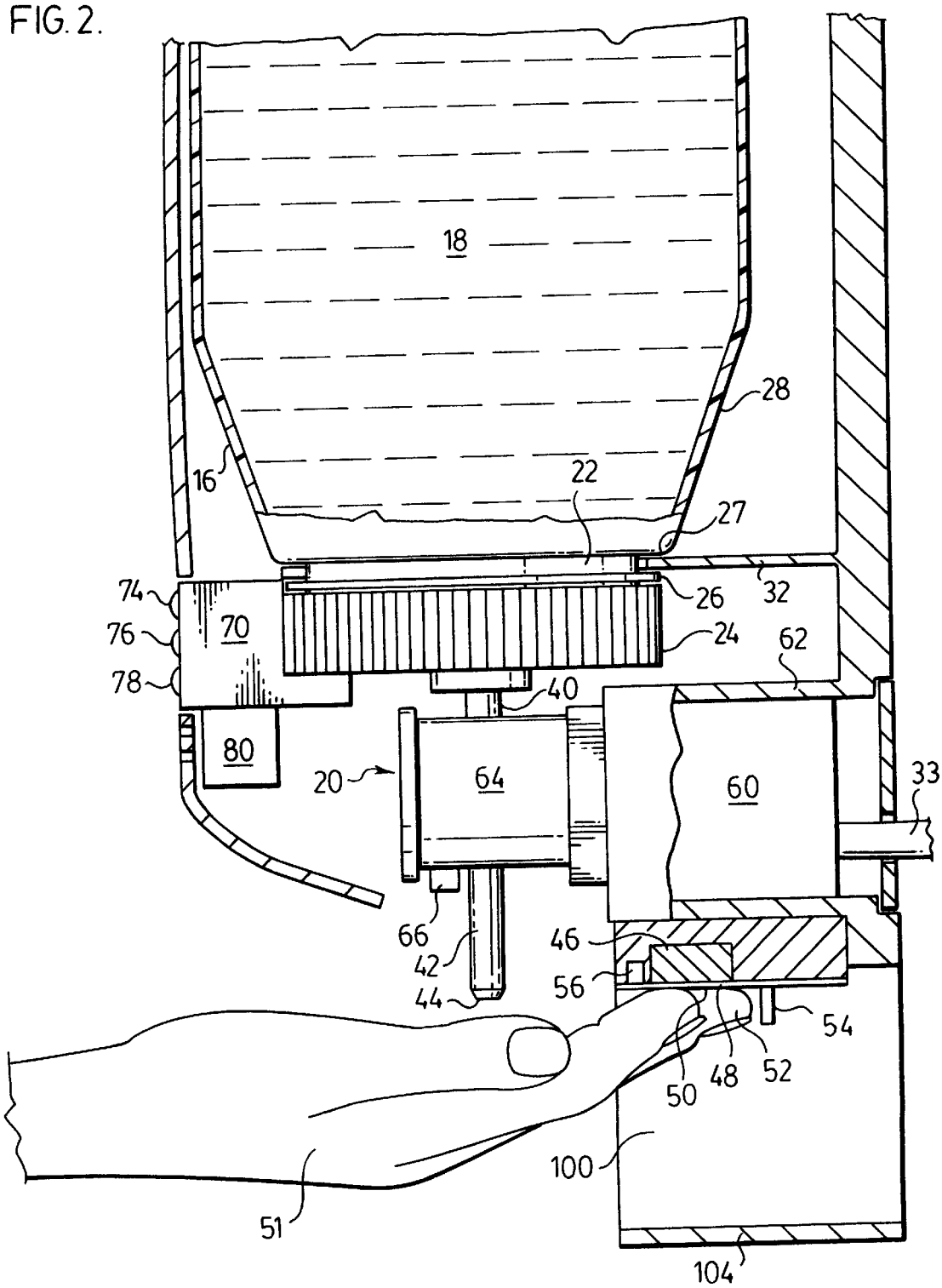
FIG. 2 is a schematic, partial cross-sectional side view of the dispenser of FIG. 1.

Reference is made to FIG. 2 which shows in cross-section the container 16 filled with fluid 18. The container 16 has a cylindrical outlet neck 22 which is externally threaded at its end to threadably receive a cap 24. The neck 22 has a radially outwardly extending flange 26 disposed closely under a radially outwardly extending portion 27 of the wall 28 of the container so as to present a radially extending support slot therebetween. The housing 10 has a horizontally extending support plate 32 with a forwardly open U-shaped slot 34 therein sized to be complementary to the support slot such that the support plate 32 can be received in the support slot and support the weight of the container 16 and locate the container in a desired position.

The cap 24 opens into a feed tube 40. Fluid is conducted via feed tube 40 to pump 20 and then from pump 20 via an exit tube 42 to out a dispensing outlet 44.

A motor 60 is mounted in a motor casing 62 in the housing 10 carrying a forwardly opening socket 64 which is sized to removably receive the pump 20 therein for operative coupling of the motor 60 to drive the pump 20.

A control mechanism is provided to control operation of the dispenser.

The control mechanism includes a fingerprint reader 46 having a reader bed 48 on which the tip 50 of a finger 52 whose print is to be read, preferably the second finger, is to be placed. To assist a user in locating the fingertip 50 on the reader bed 48 finger locating devices such as a stop flange 54 can be provided to be engaged by the end of a finger and help locate the fingertip on the reader bed 48. FIG. 2 shows the fingerprint reader 46 and outlet 44 located relative to each other such that with the fingertip 50 located on reader bed 48, the user's hand 51 is located underneath the outlet 44 in a position that material dispensed from the outlet 44 will necessarily engage the user's hand 51.

The dispenser may be controlled by the control mechanism to operate in many different manners. In one simplified manner of operation, a user places his fingertip on the fingerprint reader, the fingerprint reader will attempt to read the fingerprint and on the fingerprint reader determining that a fingerprint has successfully been read, the pump is activated to dispense a dose of fluid. In a simplified operation, the fluid would not be dispensed until a fingerprint is successfully read. Preferably, a fingerprint can be successfully read within a first short period of time, i.e. preferably less that about ⅕ of a second and, preferably, less than 1/10 of a second. Preferably, the pump can dispense a substantial portion of the dose of material, i.e. between 40% and 100% of a desired dose in a second period of less than about two seconds and, preferably, less than about one second immediately following the first period.

With the fingerprint reading operation and dispensing of material operation carried out in short periods of time, there is a high probability that the dispensed material necessarily is dispensed onto the user's hand, in that insufficient time has passed for a user to withdraw his hand from under the outlet 44 after his fingerprint has been read and before material is dispensed onto his hand.

Rather than merely rely on the mere fact that a fingerprint has been read and that the speed of reading and dispensing is such that material must have been dispensed onto a user's hand, mechanisms may be provided to more positively ensure that the fingers and/or hand is located in positions that the material when dispensed will necessarily engage the hand. In this regard, the control mechanism preferably includes at least one proximity sensor which will sense the presence of the user's hand 51 under the exit tube 42 and, particularly, during such time that material is being dispensed.

Such proximity sensor mechanisms are well known. Preferred sensors include thermal sensors which will sense the heat from a user's hand, motion sensors which will sense motion of a person's hand and photodetection sensors which will sense reflected signals from a signal emitting source provided on the dispenser. As one example, socket 64 can carry as one or more of sensors 66 and 68, a thermal sensor which would sense heat from a user's hand when placed under the exit tube 42. As another example, the element 66 could comprise, for example, an infrared light emitting diode to transmit a pulse of infrared energy at predetermined timed intervals downwardly from the housing with element 68 as a corresponding photo receiver mounted along side the photo emitter element 66 but shielded therefrom such that infrared energy of a predetermined configuration may be emitted by the diode element 66 and when reflected off a user's hand placed beneath the dispenser will be received by the receiver element 68 to signal the presence of a user's hand. Such a system is described, for example, in U.S. Pat. No. 4,967,935 to Celeste, issued Nov. 6, 1990.

While not necessary, the control mechanism may also preferably include a finger sensing device to sense the presence of a user's finger under the fingerprint reader 46. The fingerprint reader 46 may, preferably, itself comprise not only a mechanism to read a fingerprint, but also a mechanism which senses whether a finger is located on or proximate to the reader bed 48. Alternatively, a separate sensor could be provided, for example, as a pressure sensor, thermal sensor, photodetection sensor or proximity sensor as indicated as 56 separate from the fingerprint reader 46 being provided preferably on or adjacent the reader bed 48.

The sensors can be used to sense the location of the hand and/or finger before reading a fingerprint, while reading a fingerprint and/or after reading a fingerprint. The sensors are useful before reading a fingerprint to assist in providing instructions to a user to locate his finger on the reader. During reading, the sensors are useful to provide instructions to hold the finger on the reader and to measure the time for a reading to be taken. After reading a fingerprint, the sensors are useful to positively ensure that during the period of time that material is dispensed that the material dispensed will necessarily engage the hand because the user's hand or fingers are sensed to be in desired locations.

The dispenser can be controlled using at least one sensor to sense the proximity of the user's hand within a desire proximity to the outlet 44 during the time that material is being dispensed. In FIGS. 1 and 2, one or more of sensors 66 and 68 can sense the proximity of the hand during the period that material is being dispensed, i.e. while the pump 20 is activated. The control mechanism can then generate a signal of positive dispensing onto the user's hand.

In FIGS. 1 and 2, the fingerprint reader 46 alone could be used as a proximity sensor so as to sense, after a fingerprint has been successfully read, whether the fingers are kept within a desired proximity to the outlet 44 and/or reader bed 48 during the period that the pump is activated. Similarly, sensor 56 alone could be used as a proximity sensor so as to sense whether the fingerprint and/or hand are kept within a desired proximity to the outlet 44 and/or reader bed 48 during the period that the pump is activated.

Using the sensors 66 and 68 to sense the proximity of the use's hand under the outlet during dispensing can permit dispensing onto the user's hand without requiring, for example, that the fingertip 50 be physically in contact with the reader bed 48 and can permit a user after receiving a signal of reading of the fingerprint with the finger and/or hand in a first position, to adopt a second position during dispensing by the pump.

A signal mechanism is preferably provided to provide signals and feedback to a person using the dispenser. In FIGS. 1 and 2, a visual signal device 70 is secured to the housing 10 and is visible through a window 72 in the cover 14. The visual signal device 70 is provided with an array of three signal lamps 74, 76 and 78 which can provide various signals to a user and preferably are capable of being unlit or showing different colours such as red or green. On the cover 14, adjacent the location that each of the lamps appear in the window 72, written indicia may be provided in boxes 75, 77 and 79 to interpret the lamp's signals.

FIGS. 1 and 2 also show an audio signal device or loud speaker 80 to pass audio signals such as pre-recorded language signals and musical notes, tones, buzzes and alarms. The sound may pass through the cover 14 as by an array of holes 82.

The sensors shown in the first embodiment of FIGS. 1 and 2 include the fingerprint reader 46, sensor 56 and sensors 66 and 68. These sensors may be used in combination to provide various signals. For example, with sensors 66 and 68 sensing a hand in a desired proximity to the outlet 44 and sensor 56 and/or the fingerprint reader 46 sensing a finger on the reader bed but the reader indicating it is unable to read a fingerprint, the control mechanism could give a signal requesting the user to ensure it is the second finger that is located on the reader bed with its tip engaging stop 54.

The control mechanism can over time obtain information from the fingerprint reader, the various sensors and the pump and recognize various situations in which various signals may be generated, communicated and/or recorded.

For example, in one operation, on a person initially placing the hand under the dispenser, one of the fingerprint reader and the sensors can sense the hand and/or fingers and give a first signal to place on and/or move the second finger on the reader bed. Such a request could be continued either until the location of a finger on the bed is sensed when a second signal of hold could be given or until the fingerprint is read. Similarly, after the fingerprint is read, a signal of hold could be given. After material is dispensed and the sensors have sensed that the hand/fingers were in the desired position while material was dispensed, a third signal of successful dispensing could be given with instructions to remove hand. These first, second and third signals could be communicated by each of lamps 74, 76 and 78 becoming lit beside suitable written notices displayed on the cover in boxes 75, 77 and 79. Each signal could also be accompanied by an audio message.

The dispenser preferably is physically configured such that with the fingertip on or proximate the fingerprint reader to read a print that the hand will necessarily be located under the outlet. Using sensors such as 66 and 56 at different locations can be of assistance in ensuring a hand is in a correct position and that a user has not, for example, placed his fingers on the reader from the side without his hand being under outlet 44. Preferably, the dispenser is physically arranged as with the side panels 100 of the housing 10 to extend downwardly past the reader and possibly with a bottom plate 104 to prevent a finger from being read other than with the hand under the outlet.

The dispenser should include a system for ensuring that material is actually dispensed and this could include the use of the sensors 66 and 68 to directly sense that material moves downwardly from the outlet 44. As well as in U.S. Pat. No. 5,682,402, various arrangements can be made to monitor that there is fluid 18 in the container, that the pump is operative, that the pump is supplied with power, and/or that the dispenser systems are generally functional, and these monitoring arrangements could be used to deduce whether material is actually dispensed.

Figure 3:
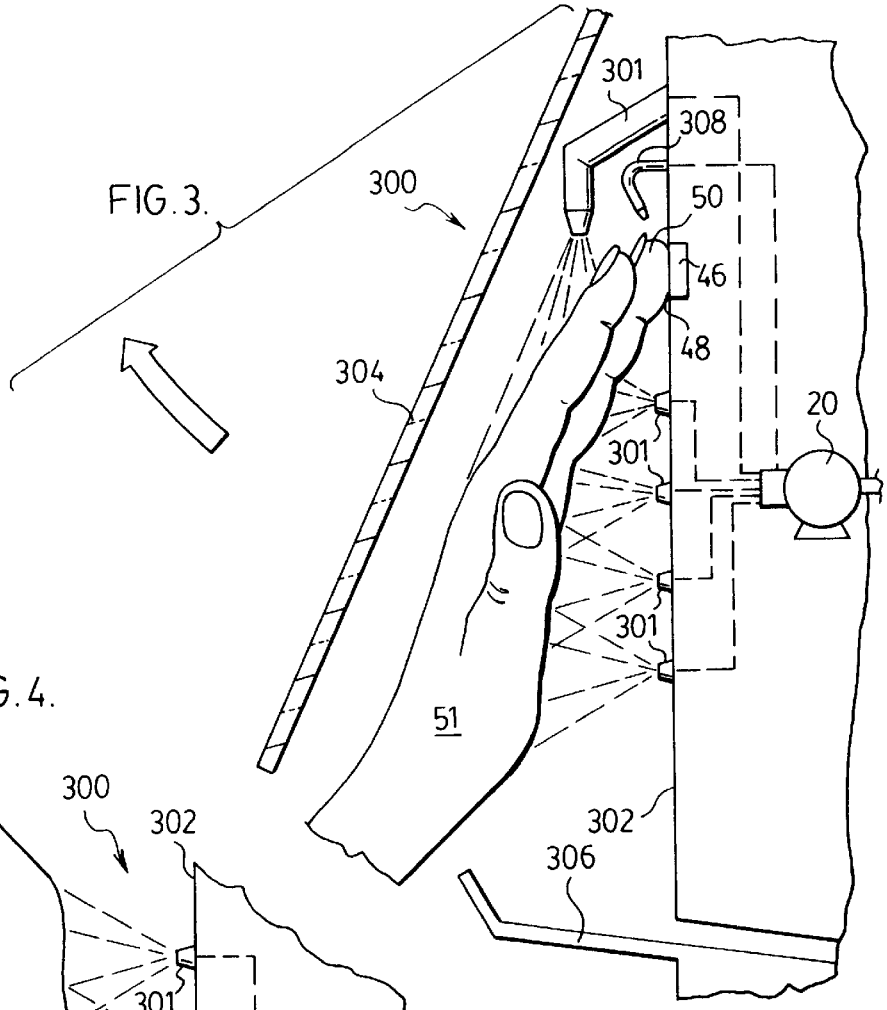
FIG. 3 is a schematic side view of a dispenser in accordance with a second embodiment of the present invention.

Reference is made to FIG. 3 which shows a second embodiment of a dispenser in accordance with the present invention. In FIG. 3, the dispenser generally indicated 300 carries an internal pump 20 connected to various outlets or nozzles 301 adapted to spray material such as an alcohol based disinfectant onto the palm and the back of a user's hand 51 positioned with a fingertip 50 on the bed 48 of the fingerprint reader 46. The dispenser 300 is provided with a front face 302 preferably disposed approximately vertically and at about shoulder to eye height relative a user to assist a user in locating his finger on the reader. A transparent cover plate 304 is shown through which a user can see his hand and the location of the reader. The cover plate 304 assists in containing spray from the nozzles and may be mounted to be able to be swung upwardly for cleaning. A bottom tray 306 is provided to assist in catching any overspray and drippings of the material.

FIG. 3 shows an auxiliary nozzle 308 which is to direct a spray of the disinfectant onto the reader bed. Flow through nozzle 308 is preferably controlled separately from flow through the other nozzles 301 such that after dispensing onto the person's hand and/or once the fingers have been removed from the reader, material is sprayed onto the reader to clean it and reduce contamination to the next user to touch the reader.

Figure 4:
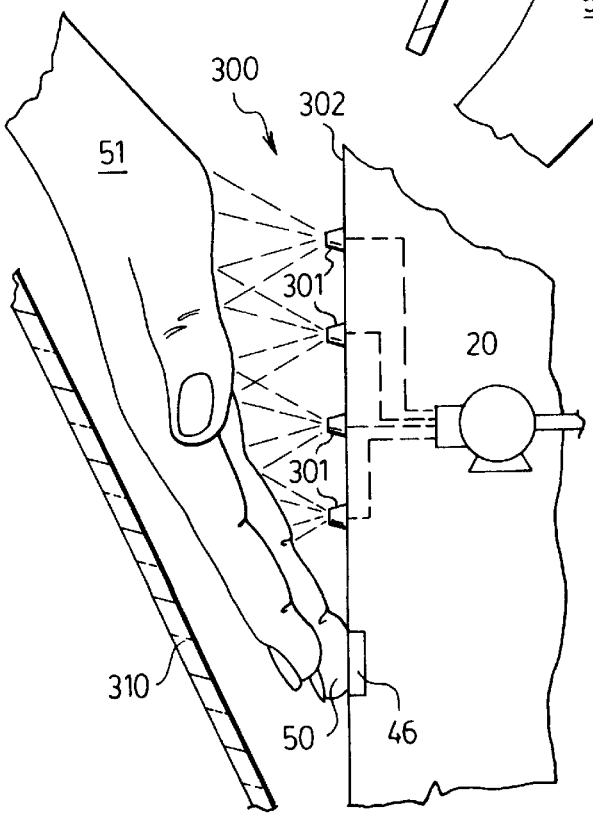
FIG. 4 is a schematic side view of a dispenser in accordance with a third embodiment of the present invention.

The third embodiment of a dispenser shown in FIG. 4 is similar to the second embodiment, however, with the dispenser 300 to have its front face 302 located generally vertically and at a convenient position below the shoulders of a user with the hand 51 directed downwardly when a finger 50 is located on the reader 46 and in front of the nozzles 301. A cover plate 310 is provided to contain overspray and catch and direct any drippings.

Figure 5:
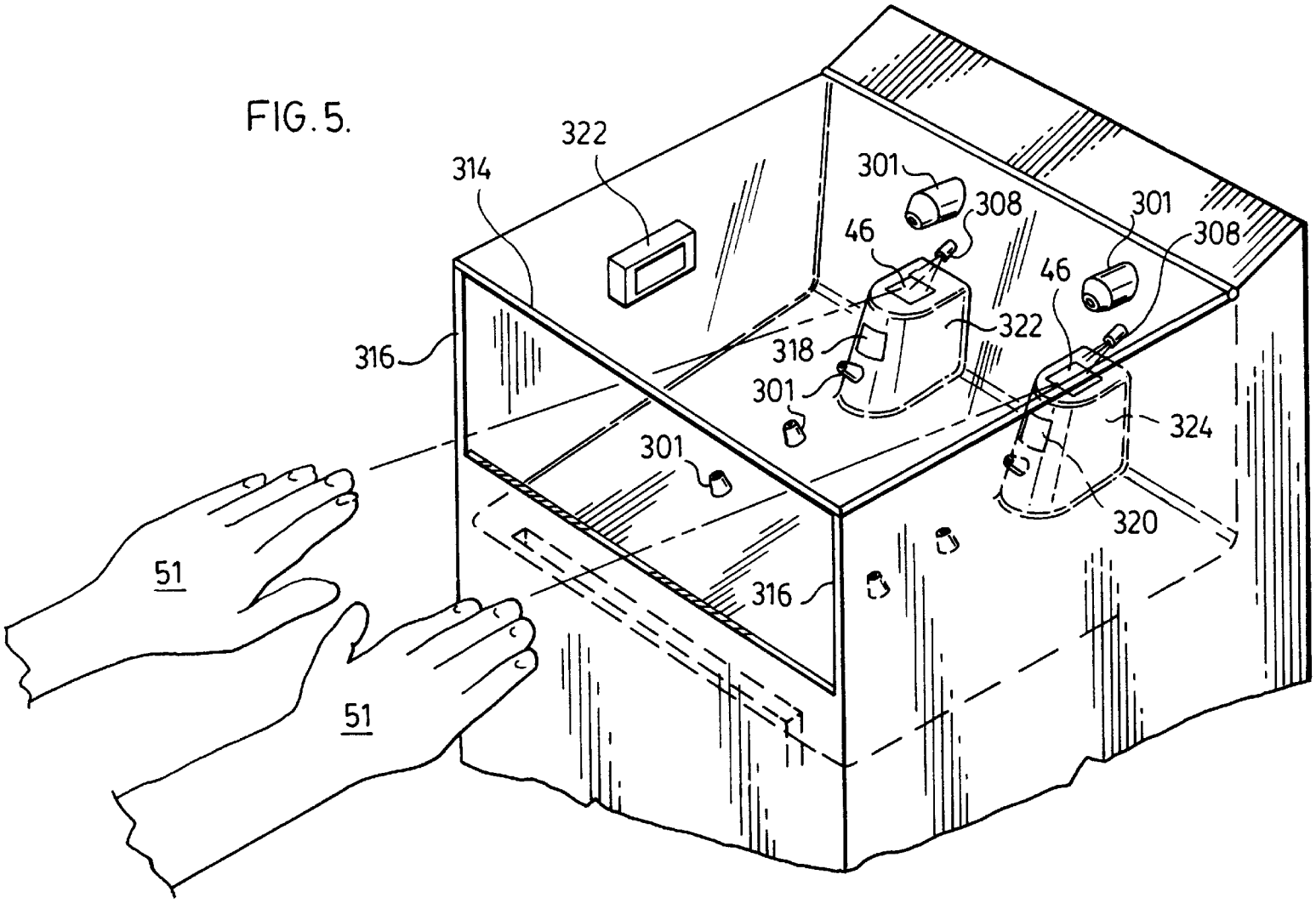
FIG. 5 is a perspective view of a dispenser in accordance with a fourth embodiment of the present invention.
Figure 6:
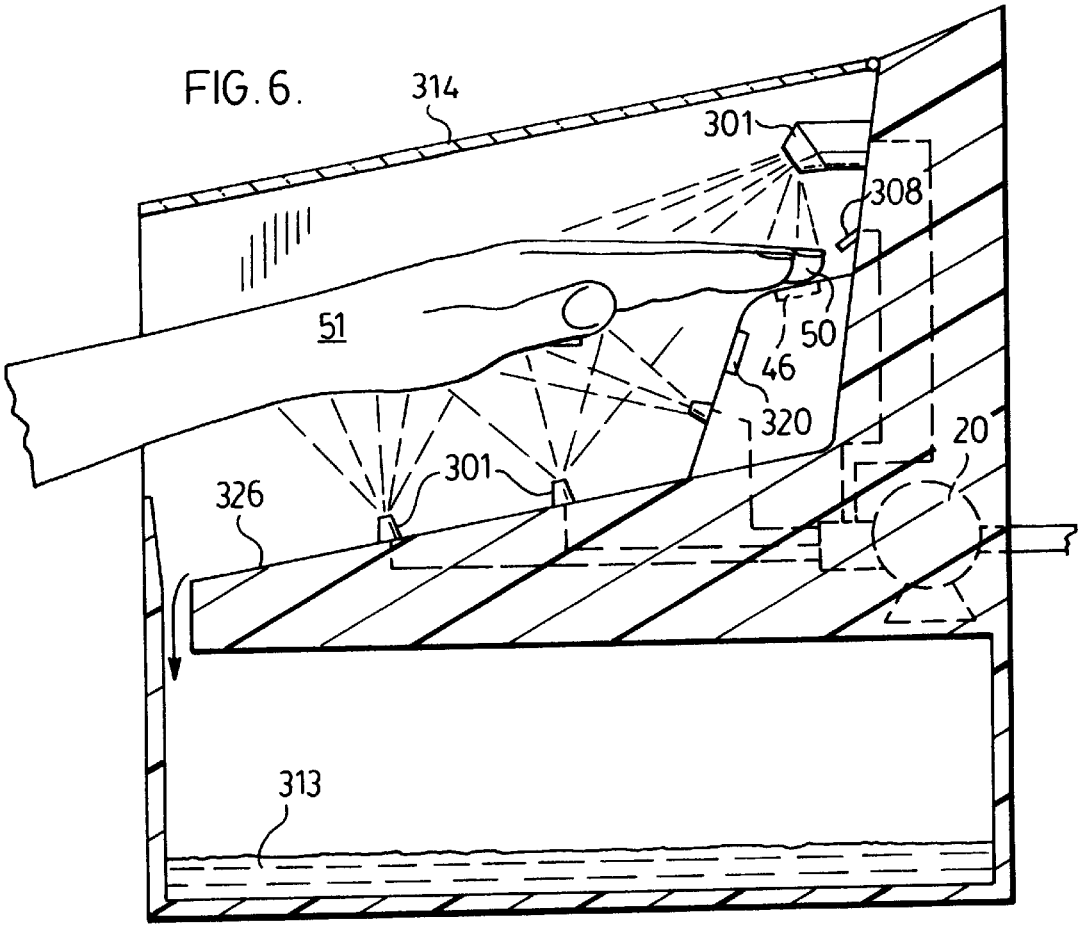
FIG. 6 is a schematic, partially cross-sectional side view of the dispenser of FIG. 5 showing dispensing onto a person's hands.
Figure 7:
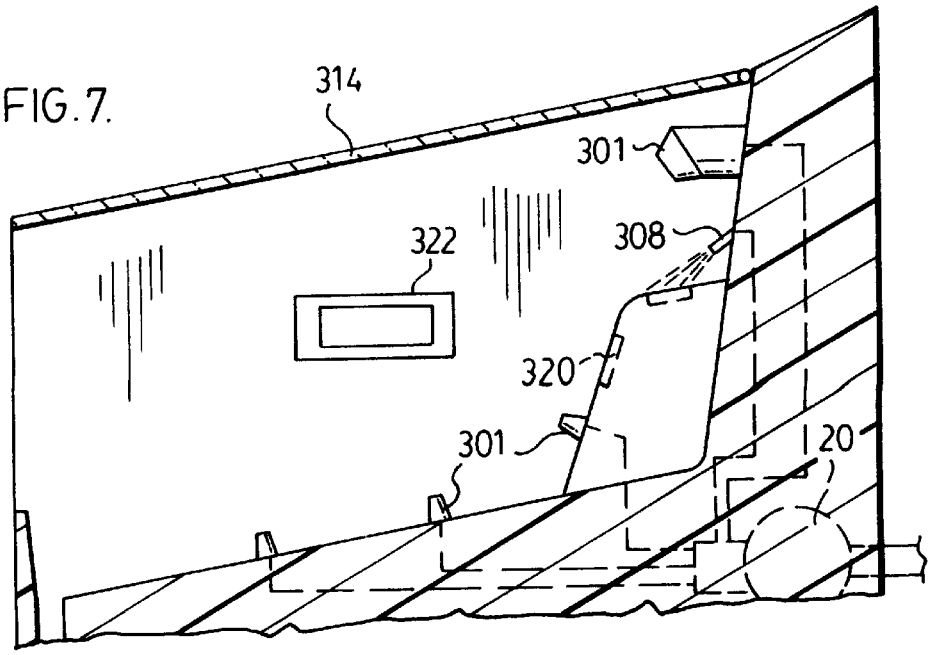
FIG. 7 is a side view the same as FIG. 6 but showing dispensing to clean a fingerprint reader.

A fourth embodiment of the invention is shown in FIGS. 5, 6 and 7. In the fourth embodiment, two fingerprint readers 46 are provided, one for each hand. Various nozzles 301 are provided to direct sprayed liquid onto the front and back of a user's hands as shown in FIG. 6. As well, an auxiliary nozzle 308 is provided to spray liquid onto each reader 46 either simultaneously with spraying from the nozzles 301 or independently as shown in FIG. 7. A sump 313 may be provided to collect drippings and overspray.

The dispenser of FIGS. 5, 6 and 7 is provided with a shroud comprising transparent top 314 and sides 316 to contain overspray and limit a user to holding his arms in a desired orientation. Sensors to sense finger and hand proximity, and/or actual spraying are provided for each hand as 318 and 320 and at one side as 322. Each reader 46 is supported on a narrow pedestal member 322 and 324 above catch surface 326 such that on a person's fingertip resting on reader 46, the top and bottom surfaces of the hand are accessible to be sprayed, preferably with the hands extended generally horizontally as shown.

The fingerprint reader 46 is preferably of a commercially available type such as commercially available from Compact Computer Corporation as Fingerprint Identification Technology, for example, described on the Internet at http://www.compaq.com/im/fit, and providing small fingerprint readers and supporting software. Such fingerprint readers incorporate a device such as a camera or scanner to capture an image of a fingerprint. Software including algorithms convert the image into a unique map of minutiae points which is encrypted and can be stored. The fingerprints of employees can be stored in a database as such encoded map and any fingerprint read cross-referenced to identify the user.

The fingerprint reader 46 may be connected directly to a conventional commercially available computer, as by hard wiring the reader 46 to a computer. Similarly, the entire control system for the dispensers including its sensors, their readings, signals generated and general operation data may be delivered to a computer or controlled by a computer. With data recorded in the computer as to the identification of users using the dispensers over time, use of the dispensers by employees can be monitored.

Rather than have a dispenser hard wired to a computer capable of handling all computer manipulations desired, it is possible to provide the dispenser with its own microprocessing capabilities capable of controlling its operations and of recording essential data about a fingerprint read. For example, the dispenser might be able to capture an image of a fingerprint and/or convert it into an encrypted data format together with other data such as time and whether the hand was kept under the outlet when fluid was dispensed. This data could be stored in a memory device in the dispenser. Periodically, the dispenser could be connected to a reading device to download the stored data for delivery to and processing by a more powerful conventional computer.

A successful reading of a fingerprint to activate dispensing could in one aspect merely record all of an image of the print in some form and, in another aspect, provide positive identification of the user. Where there is positive identification of a user as by comparison of the print read with stored prints, the opportunity arises for individualized action and/or immediate feedback to that user.

The dispenser could be adapted to be battery powered as in the manner taught by U.S. Pat. No. 5,836,402, however, preferably, is powered by permanent power systems as via conduit 83 shown in FIG. 2, which may provide low voltage direct power to provide safety and compatability with needs of powering the fingerprint reader and other computer control systems for the dispenser. The conduit 83 may also be used for hard connection of the dispenser to a remote computer. A plurality of similar dispensers could be connected to one computer or networked.

Operation of the dispenser of FIGS. 1 and 2 can be controlled so as to not require the reading of a fingerprint or confirmation of reading of a fingerprint to activate dispensing of fluid. For example, on the fingerprint reader 46 or its bed 48 or sensor 56 or sensors 66 and 68, sensing the proximity of fingers or a hand within a desired first proximity for a first period of time say possibly one to two seconds, typically necessary for a fingerprint to be recorded, whether or not the fingerprint reader is present or operative or can signal that a print has been read, the pump may be activated. While the pump is activated, the sensors can monitor the proximity of the fingers and/or hand within a desired second proximity for a second desired period of time, say one to two seconds following the first period of time. A user would be unaware that a record of his fingerprint may or may not have been taken but would expect he needed to satisfy the need to have his finger on the reader bed. Avoiding the need to have the dispenser have the capability of signalling whether it has captured an adequate image avoids the possible image processing capacity in the dispenser as may be advantageous where the dispenser will only periodically have its data downloaded for further processing.

Figure 8:
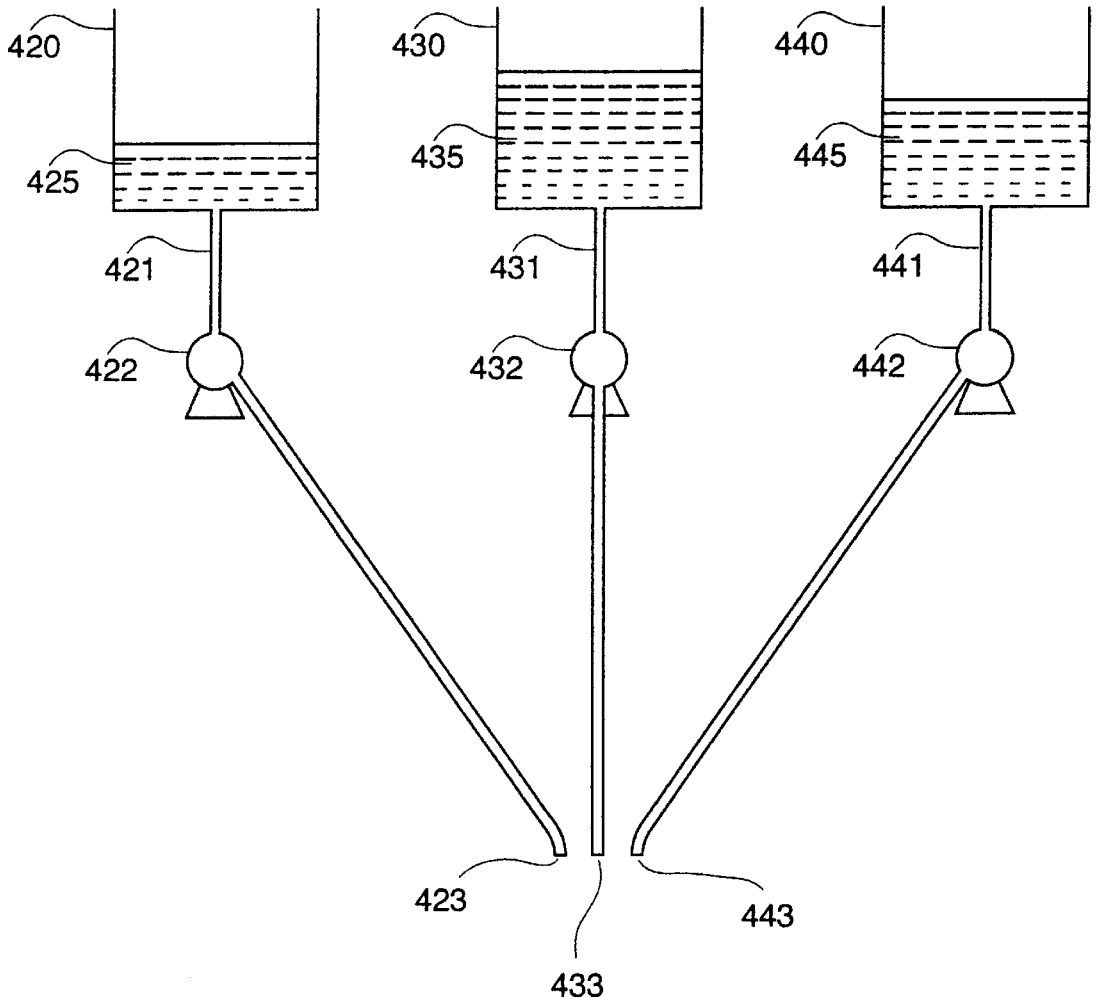
FIG. 8 is a schematic flow diagram of an arrangement which permits customized selection and mixing of different materials which may be desired to be dispensed.

Reference is now made to FIG. 8 which schematically shows three fluid containers 420, 430 and 440 each connected by associated conduits 421, 431 and 441 to pumps 422, 432 and 432 and to an associated nozzle outlet 423, 433 and 443. Nozzles 424, 434 and 444 are shown disposed proximate to each other so as to preferably on brief operation of the pumps simultaneously dispense a mixture of one or more of the materials 425, 435 and 445 separately contained in each of the respective containers. The nozzles could, for example, be concentric, or be located close to each other or dispensed into a small volume mixing chamber.

The combination of three nozzles could, for example, be provided as any one of the nozzle outlets, for example, shown as 301 and 308 in FIGS. 4 to 7.

A control mechanism can be provided so as to control operation of the pumps 422, 432 and 442 so as to dispense one, two or three of the materials from each of the plurality of containers in relative desired proportions. For example, the pumps 422, 432 and 442 could be metering pumps and can be adapted to be operated at different speed. For example, by operating each pump at a particular relative speed compared to the other pumps and having regard to the nature of the materials each pump is to be dispensed, it would be possible to have a resultant mixture representing the sum of the material extruded from the nozzles over a short period of time to be within a desired range of composition. By changing the relative speed or length of time of operation of the motors, the relative composition of the extruded mixture can be customized and adjusted.

An array of containers containing at least two different materials to be dispensed can be provided in association with a dispenser as illustrated in FIGS. 1 to 7 such that the dispenser on identifying the user by the fingerprint reader, or alternatively by other means, can select the material or materials to be dispensed. For example, an individual person who has to wash their hands frequently may be identified as someone who has dry skin. One of the components in the individual bottles might be a moisturizer and for that individual, an additional amount of the moisture might be dispensed when the device identifies that particular user. Similarly, where persons in the workplace may be required to wash their hands, for example, every 20 minutes over the course of a work day, it may be advantageous to vary the materials being dispensed from time to time as, for example, to merely dispense a disinfectant periodically, say every fourth time the person washes their hands.

The device could permit selections to be made by different users. For example, some workers may not desire to have any perfumed products dispensed to them and, therefore, a selection of different components which may have varying degrees of scenting or perfume could be suitably programmed into the control system to be customized for a particular user.

To assist in calibrating the relative flow from the different containers, it may be possible to have the fluid in each of the containers be relatively comparable, such as, density, viscosity and the like, such that each may contain, for example, predominantly a base component as a soap, however, with different quantities of other additives added to the soap, such that by mixing two different types of soap from two different containers a desired mixture may be obtained.

Providing for the separation of materials to be dispensed can be advantageous. For example, some materials to be dispensed may have a reduced shelf life after they are mixed with other components. By keeping the components separate until they are sprayed onto the user's hands, difficulties may be overcome in reducing shelf life of a mixture or in one component of the mixture negatively affecting another component of the mixture over time. Possibly, use of expensive or disadvantageous preservatives may be avoided.

While a mixing apparatus as shown in FIG. 8 may preferably be used in conjunction with a finger print reading system as shown in FIGS. 4 to 7, it is to be appreciated to be within the scope of this invention that such customized mixing arrangement for spraying or dispensing material onto a user's hands could also be operated by other customized identification, such as, an identification card or a number of keypad or the like.

A dispenser as shown in FIG. 8 can be used in accordance with the present invention to test different materials as by having different materials dispensed onto selected different users, as for example, to gather scientific performance data over time, and the present invention covers the use of such a dispenser for controlled test purposes. The dispenser of FIG. 8 could also be used for security purposes as for example with one of the materials to be dispensed to include a die or marker such as one which irradiates under florescent light and could be used to identify that user or to identify items which may have been touched by that user. Many other uses will be apparent to persons skilled in the art.

Various arrangements may be made for mixing the materials, for example, rather than have all three of the materials 425, 435 and 445 mixed simultaneously as shown in FIG. 8, two of the materials could be mixed and then the third material and other materials added to the mixed first two materials. The nozzle outlets 423, 433 and 443 could all connect to a further pump (not shown) which could mix and further dispense the mixture. Similarly, where any two materials may be mixed, a further pump could be provided to mix and further dispense the materials, either to an end user or into further mixing with other materials.

The invention has been defined with reference to preferred embodiments. Many modifications and variations will occur to persons skilled in the art. For a definition of the invention, reference is made to the appended claims.

I claim:

1. A dispenser to dispense material on to a person's hand, comprising:

dispensing means to dispense material from an outlet when the dispensing means is activated, a fingerprint reader adapted to read a fingerprint of a user's finger when located proximate thereon, control means to activate the dispensing means to dispense material from the outlet when a user's finger is proximate the reader, the outlet and the reader positioned relative each other such that when a user's finger is located proximate the reader material dispensed from the outlet engages a user's hand, the material comprises a first material and a second material, the dispensing means comprising a first dispenser to dispense from the outlet the first material from a source of the first material and a second dispensing means comprising a second dispenser to dispense from the outlet the second material from a source of the second material, a first control mechanism to control the relative amount of the first material and second material dispensed when the dispensing means is activated, mixture control means selecting the relative amounts of the first material and the second material to be dispensed when the dispensing means is activated having regard to the identity of the user whose finger print is read.

2. A dispenser as claimed in claim 1 wherein the control means activates the dispensing means to dispense material after the reader has read a fingerprint.

3. A dispenser as claimed in claim 1 including recording means to maintain a record of a fingerprint read by the reader.

4. A dispenser as claimed in claim 1 wherein the reader is adapted to read a fingerprint of a user located within a desired first proximity to the reader;

the dispenser including sensing means to sense over time whether a finger is within said first desired proximity to the reader.

5. A dispenser as claimed in claim 4 wherein the control means activates the dispensing means to initiate dispensing of material after the sensing means has sensed the location of a finger within said first desired proximity for a first period of time.

6. A dispenser as claimed in claim 2 wherein the material dispensed from the outlet engages a hand of the user when the user's hand is within a second desired proximity to the reader;

a sensing mechanism sensing whether a user's hand is within the second desired proximity to the reader during the entirety of a second period of time when the dispensing means is activated.

7. A dispenser as claimed in claim 6 including recording means to maintain a record of the fingerprint read and whether a hand was located within said second desired proximity to the reader during the second period of time when the dispensing means was activated.

8. A dispenser as claimed in claim 2 including read signal means to signal to a user that a fingerprint has been read.

9. A dispenser as claimed in claim 4 including read location signal means to signal to the user that the user's hand is within the first desired proximity to the reader.

10. A dispenser as claimed in claim 6 including dispensing location signal means to signal to the user that a user's hand is within the second desired proximity to the reader.

11. A dispenser as claimed in claim 1 including finger location signal means to signal to the user that the user's finger is proximate the reader to permit a fingerprint to be read or for material dispensed to engage the user's hand.

12. A dispenser as claimed in claim 1 including recording means to maintain a record of a fingerprint recorded and whether a finger whose fingerprint was read was maintained while material was dispensed proximate the reader such that material dispensed would have engaged the user's hand.

13. A dispenser to dispense material onto a person's hand, comprising:

dispensing device to dispense material from an outlet when the dispensing means is activated, a fingerprint reader having a finger bed, the reader adapted to read a fingerprint of a user when located on the bed, a sensing mechanism to sense the location of a finger on the bed, a control system to activate the dispensing device to dispense material after the sensing mechanism has sensed the location of the finger on the bed, wherein the sensing mechanism senses whether the finger is on the bed while the dispensing device dispenses the material, a recording system to maintain a record of a fingerprint read and whether its respective finger was on the bed while the dispensing device dispensed material, the material comprising a first material and a second material, the dispensing means comprising a first dispenser to dispense from the outlet the first material from a source of the first material and a second dispensing means comprising a second dispenser to dispense from the outlet the second material from a source of the second material, a first control mechanism to control the relative amount of the first material and second material dispensed when the dispensing means is activated, mixture control means selecting the relative amounts of the first material and the second material to be dispensed when the dispensing means is activated having regard to the identity of the user whose finger print is read.

14. A dispenser as claimed in claim 13 including a bed cleaner to dispense material onto said finger bed when activated.

15. A dispenser as claimed in claim 13 wherein said control system activates said bed cleaner after the sensing mechanism senses a finger has been removed from the bed.

16. A method of dispensing material onto a person's hand, comprising:

placing a user's hand such that a fingertip of a finger to be read is on or proximate a fingerprint reader, reading a fingerprint of the user's finger placed on or proximate the fingerprint reader, after reading the fingerprint maintaining the user's hand within a control space proximate the reader for a period of time, during said period of time, dispensing relative amounts of a first and a second material into the control space in a manner that the material engages the user's hand within the control space, and selecting the relative amounts of the fist material and the second material to be dispensed having regard to the identity of the user whose finger print is read.

17. A method as claimed in claim 16 including removing the finger from being on or proximate the reader and after removing the finger dispensing material onto the reader to clean the reader.

18. A method as claimed in claim 16 wherein the at least one of the first material and the second material is dispensed to engage the hand within the control space and simultaneously onto the reader to clean the reader.

19. A method as claimed in claim 16 including recording a fingerprint read.

20. A method as claimed in claim 16 including recording a fingerprint read and whether a user's hand was maintained within the control space for a desired period of time while the first material and the second material was dispensed.

* * * * *